US008997267B2

(12) United States Patent
Skottheim et al.

(10) Patent No.: US 8,997,267 B2
(45) Date of Patent: Apr. 7, 2015

(54) PROTECTIVE GARMENT WITH SEPARATE INNER AND OUTER SHELLS

(75) Inventors: Leif Skottheim, Malung (SE); Alain Castonguay, Blainville (CA); Pierre Paiment, St-Jerome (CA)

(73) Assignee: Sport Maska Inc., Montreal (CA)

( * ) Notice: Subject to any disclaimer, the term of this patent is extended or adjusted under 35 U.S.C. 154(b) by 932 days.

(21) Appl. No.: 11/812,486

(22) Filed: Jun. 19, 2007

(65) Prior Publication Data

US 2008/0313793 A1 Dec. 25, 2008

(51) Int. Cl.
*A41D 13/00* (2006.01)
*A41D 13/015* (2006.01)

(52) U.S. Cl.
CPC ..... *A41D 13/0153* (2013.01)

(58) Field of Classification Search
USPC ..... 2/462, 465, 102, 267, 115, 456, 459, 2/463, 414
See application file for complete search history.

(56) References Cited

U.S. PATENT DOCUMENTS

| | | | | |
|---|---|---|---|---|
| 1,970,130 | A * | 8/1934 | Dickenson | 2/462 |
| 4,217,705 | A | 8/1980 | Donzis | |
| 4,370,754 | A | 2/1983 | Donzis | |
| 4,453,271 | A | 6/1984 | Donzis | |
| 4,507,801 | A * | 4/1985 | Kavanagh et al. | 2/462 |
| 4,590,622 | A | 5/1986 | Wolfe et al. | |
| 4,866,789 | A | 9/1989 | Dorm | |
| 5,129,101 | A * | 7/1992 | Douglas | 2/462 |
| 5,159,715 | A | 11/1992 | Jurga et al. | |
| 5,226,192 | A | 7/1993 | Jones et al. | |
| 5,390,368 | A | 2/1995 | Chang | |
| 5,530,966 | A | 7/1996 | West | |
| 5,557,804 | A | 9/1996 | Ovortrup et al. | |
| 5,623,728 | A * | 4/1997 | Wagner | 2/462 |
| 6,098,208 | A | 8/2000 | Cordon | |
| 6,295,654 | B1 * | 10/2001 | Farrell | 2/456 |
| 6,446,273 | B1 * | 9/2002 | Gillen et al. | 2/455 |
| 6,553,579 | B1 | 4/2003 | Gillen et al. | |
| 6,748,601 | B2 * | 6/2004 | LaShoto et al. | 2/102 |
| 2002/0026664 | A1 | 3/2002 | Grounds et al. | |
| 2007/0050886 | A1 * | 3/2007 | Brassill | 2/115 |

* cited by examiner

*Primary Examiner* — Richale Quinn
(74) *Attorney, Agent, or Firm* — Birch, Stewart, Kolasch & Birch, LLP

(57) ABSTRACT

A protective garment comprising a form-fitting, stretchable inner garment for covering part of a body of a wearer, the inner garment including a plurality of cushioning pads attached thereto with portions of the inner garment being free of the cushioning pads, and an outer shell partially overlying the inner garment, the outer shell including a plurality of flexibly interconnected protective pads cooperating with the cushioning pads to protect at least a major part of the portion of the body, the protective pads being more rigid that the cushioning pads, and the outer shell being separable from the inner garment.

18 Claims, 8 Drawing Sheets

PROTECTIVE GARMENT WITH SEPARATE INNER AND OUTER SHELLS

FIELD OF THE INVENTION

The present invention relates to protective garments, more particularly to protective garments used in contact sports such as hockey.

BACKGROUND ART

Typical upper body protective garments usually include numerous pads such as shoulder pads, upper arm pads and front and back plates, which are flexibly interconnected such as to be retained over the body of the wearer. The pads generally include an outer, impact protecting rigid layer and an inner more flexible cushioning layer integral to the outer layer. During play, the inner cushioning layer tends to become dirty, for example by absorbing sweat, and quickly becomes malodorous. However, the outer rigid layer generally renders the protective garment bulky and hard to manipulate for cleaning purposes, for example preventing the protective garment from being machined washable. As such, the entire protective garment must be changed when the inner cushioning layer becomes too dirty and/or malodorous for use.

Accordingly, improvements are desirable.

SUMMARY OF INVENTION

It is therefore an aim of the present invention to provide an improved protective garment.

Therefore, in accordance with the present invention, there is provided a protective garment comprising a form-fitting, stretchable inner garment for covering part of a body of a wearer, the inner garment including a plurality of cushioning pads attached thereto with portions of the inner garment being free of the cushioning pads, and an outer shell partially overlying the inner garment, the outer shell including a plurality of flexibly interconnected protective pads cooperating with the cushioning pads to protect at least a major part of the portion of the body, the protective pads being more rigid that the cushioning pads, and the outer shell being separable from the inner garment.

Also in accordance with the present invention, there is provided a protective upper body garment comprising an inner garment made of stretchable material and including cushioning pads provided on only a portion of the inner garment, and an outer garment separate from the inner garment and retained thereover, the outer garment including at least rigid shoulder caps flexibly interconnected to one another, the shoulder caps being positioned for overlying shoulders of the wearer.

Further in accordance with the present invention, there is provided a protective garment comprising an inner stretchable garment including cushioning pads overlying at least partially ribs of a wearer, the inner garment including portions thereof free of the cushioning pads, and an outer garment including protective shells overlying at least partially shoulders, an abdomen, and a back of the wearer, the protective shells being flexibly interconnected, the outer garment being removably retained over the inner garment with at least part of the cushioning pads being left uncovered by the outer garment.

BRIEF DESCRIPTION OF THE DRAWINGS

Reference will now be made to the accompanying drawings, showing by way of illustration a particular embodiment of the present invention and in which.

DETAILED DESCRIPTION OF PARTICULAR EMBODIMENTS

Figure 1:
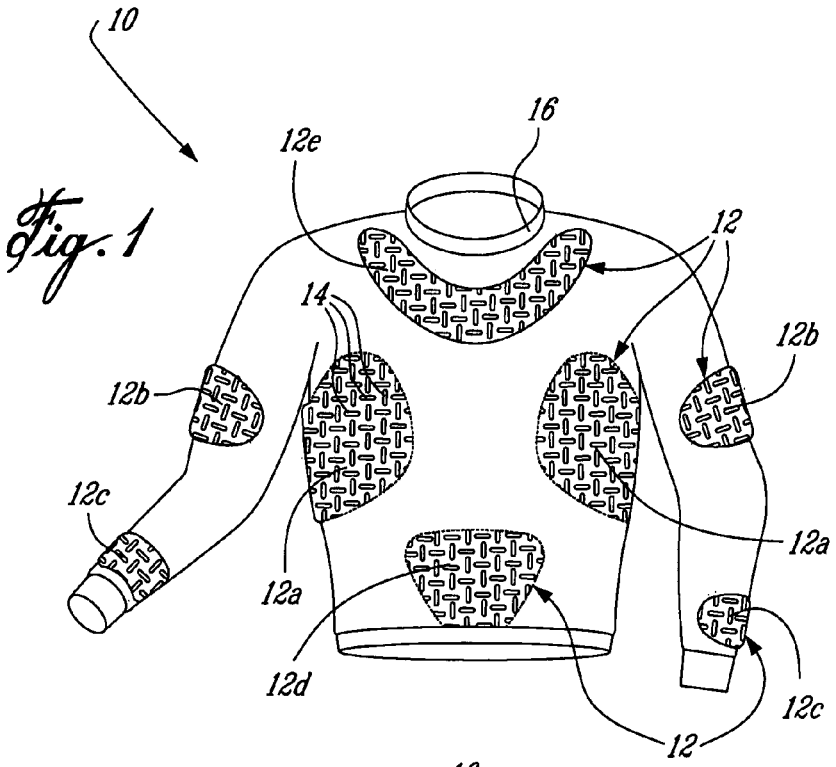
FIG. 1 is a front schematic view of an inner garment according to a particular embodiment of the present invention.
Figure 2:
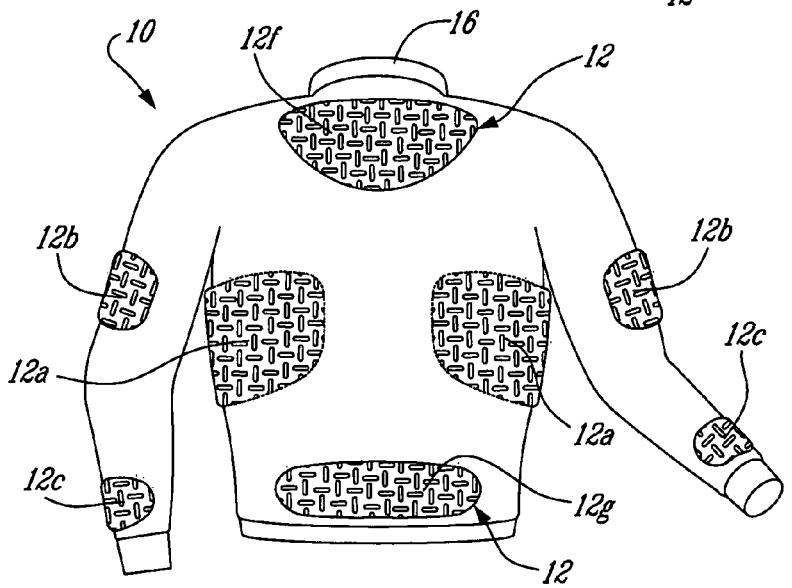
FIG. 2 is a rear schematic view of the inner garment of FIG. 1.

Referring to FIGS. 1-2, an inner garment 10 according to a particular embodiment of the present invention is schematically shown. The inner garment 10 is in the form of a long-sleeved t-shirt, and is made of stretchable, form-fitting material such as for example spandex, also known as elastane. In an alternative embodiment, the t-shirt is short-sleeved or sleeveless.

In a particular embodiment, the inner garment 10 constitutes what is commonly referred to as "compression underwear", in the manner known to enhance muscular performance and/or efficiency.

In a particular embodiment, the inner garment 10 is at least partially made of wicking and/or breathable material such as to facilitate the absorption of moisture from the body.

The inner garment 10 includes a plurality of flexible cushioning pads 12 integral therewith. In a particular embodiment, the cushioning pads 12 are permanently attached to the inner garment 10 through stitching. Alternate adequate modes of attachment can also be used, including modes of attachment allowing the cushioning pads 12 to be removable.

In a particular embodiment, the cushioning pads 12 are made of foam material, for example polyethylene, polyurethane, polypropylene, EVA foams, etc., and are thermo molded. The cushioning pads 12 shown include a plurality of slots 14 defined therein alternately oriented in two perpendicular directions, such as to improve the flexibility of the cushioning pads 12 in all directions.

In the embodiment shown, the cushioning pads 12 comprise two rib pads 12*a* which extend from the front to the back on a respective side of the torso such as to overly a portion of the ribs, two upper arm pads 12*b* each overlying a portion of an upper arm adjacent the elbow and two wrist pads 12*c* each overlying a portion of a wrist. Referring particularly to FIG. 1, the cushioning pads 12 also comprise a lower abdomen pad 12*d* overlying a portion of the lower abdomen and a U-shaped clavicle and sternum pad 12*e* extending under a front portion of a neckline 16 of the t-shirt to overlay the clavicles and an upper part of the sternum. Referring particularly to FIG. 2, the cushioning pads 12 further comprise a U-shaped lower neck pad 12*f* extending under a rear portion of the neckline 16 of the t-shirt to overlay the lower neck, and a lower back pad 12*g* overlying a portion of the lower back.

Figure 3:
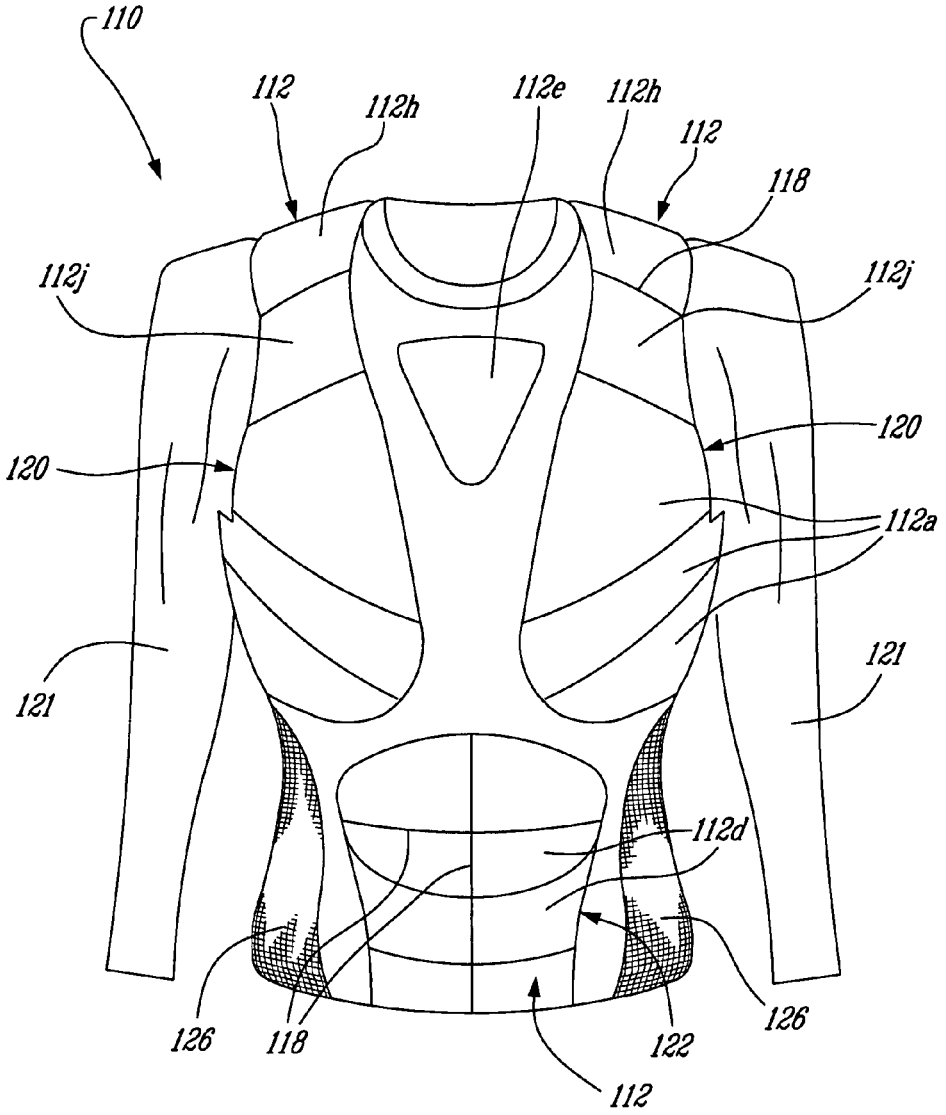
FIG. 3 is a front view of an inner garment according to an alternate embodiment of the present invention.
Figure 4:
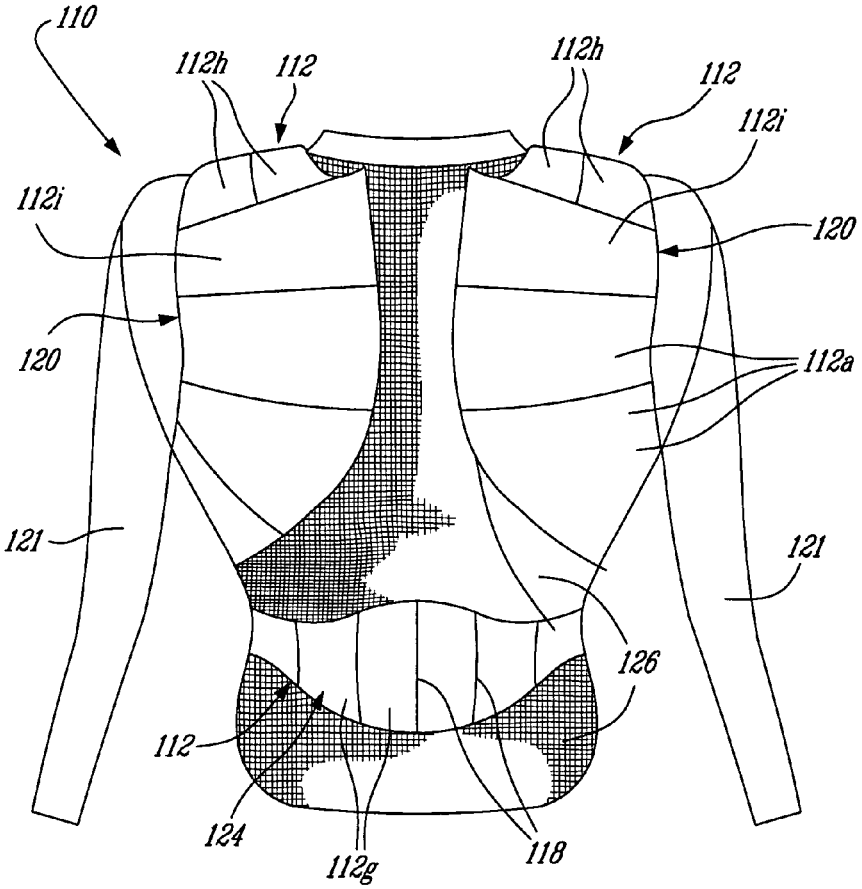
FIG. 4 is a rear view of the inner garment of FIG. 3.

Referring to FIGS. 3-4, an inner garment 110 according to an alternate embodiment of the present invention is shown. The inner garment 110 is similar to the inner garment 10 of the previous embodiment, in that it is in the form of a long-sleeved t-shirt, made of stretchable, form-fitting material, and includes a plurality of flexible cushioning pads 112 integral therewith.

However, in this embodiment the cushioning pads 112 are smaller and arranged in groups, such that a less flexible foam can optionally be used while still retaining flexibility of the inner garment 110 through the break lines 118 between the pads of a same group.

In this particular embodiment, the cushioning pads 112 comprise two side groups 120 of adjacent pads positioned such as to define a substantially O-shape around a respective arm 121 of the inner garment 110. Each side group 120 including multiple rib pads 112*a* overlying the ribs in the front and in the back, one or more shoulder pads 112*h* overlying the shoulder short of the shoulder joint, one or more scapula pads 112*i* (see FIG. 4) overlying a scapula, and one or more clavicle pads 112*j* (see FIG. 3) overlying a clavicle. Referring particularly to FIG. 3, the cushioning pads 112 also comprise a front group 122 of adjacent lower abdomen pads 112*d* cooperating to overlay a portion of the lower abdomen, as well as a sternum pad 112*e* (which in an alternative embodiment can be replaced by a group of multiple adjacent pads) overlaying an upper portion of the sternum. Referring particularly to FIG. 4, the cushioning pads 112 further comprise a rear group 124 of adjacent lower back pads 112*g* cooperating to overlay a portion of the lower back.

In a particular embodiment, the inner garment 110 includes portions 126 made of stretchable mesh material such as to improve breathability, the portions 126 of stretchable mesh material being shown here along the sides and the back of the garment 110 in between the cushioning pads 112.

Figure 5:
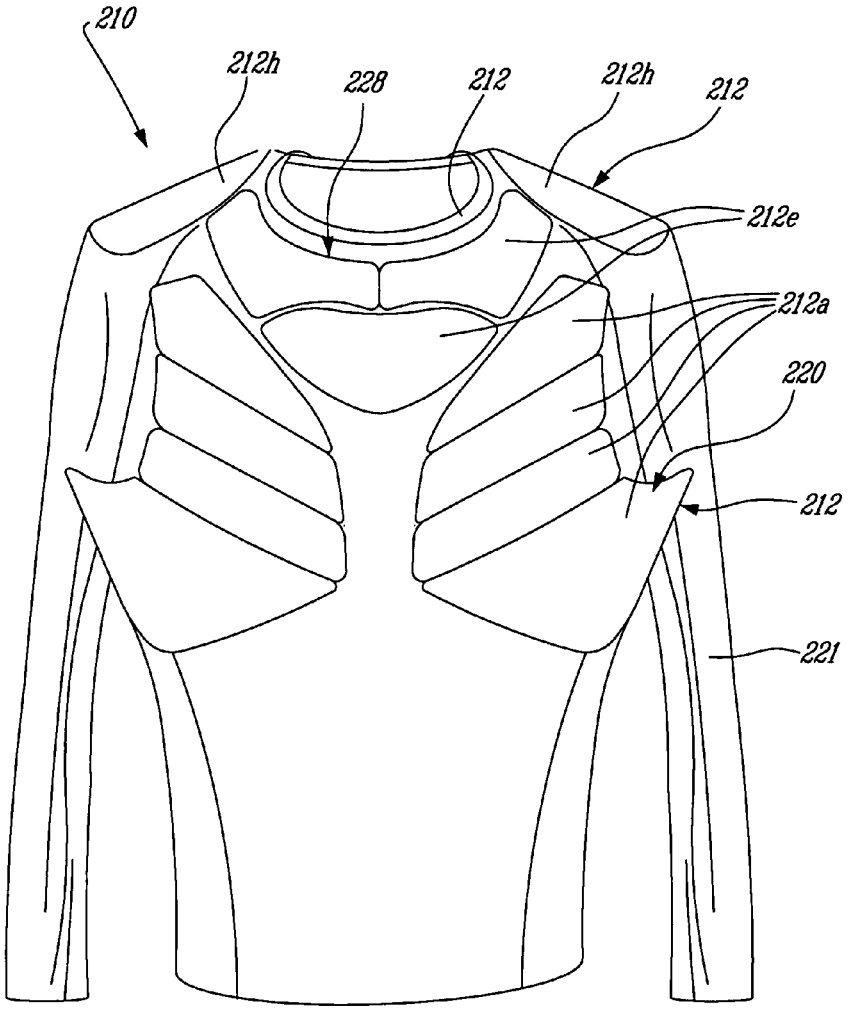
FIG. 5 is a front view of an inner garment according to another embodiment of the present invention.

Referring to FIG. 5, an inner garment 210 according to an alternate embodiment of the present invention is shown, where the cushioning pads 212 are provided in groups arranged slightly differently. Namely, the cushioning pads 212 comprise two side groups 220 of adjacent pads positioned such as to define a substantially U-shape under a respective arm 221 of the inner garment 210 with each side group 220 including multiple rib pads 212*a* overlying the ribs in the front and in the back. The cushioning pads 112 also comprise one or more shoulder pads 212*h* overlying each shoulder including the shoulder joint and which optionally extend in the back such as to overly a respective scapula. The cushioning pads 212 also comprise an upper group 228 of adjacent clavicle and sternum pads 212*e* cooperating to overlay the clavicles and an upper portion of the sternum. In a particular embodiment, the rear side of the inner garment 210 is similar to the rear side of the previously described inner garment 110 shown in FIG. 4.

In all embodiments shown, the inner garment 10, 110, 210 includes cushioning pads 12, 112, 212 overlaying desired portions of the body, and has portions thereof which are free of cushioning pads, such that the flexibility and breathability of the inner garment 10, 110, 210 can be maximized while providing protection to specific parts of the body of the wearer.

It is understood that numerous alternate embodiments for the inner garment are also possible, including more or less cushioning pads and overlying various combinations of body portions, depending on the protective needs of the wearer and on the geometry of the outer shell which will be described in the following.

Figure 6:
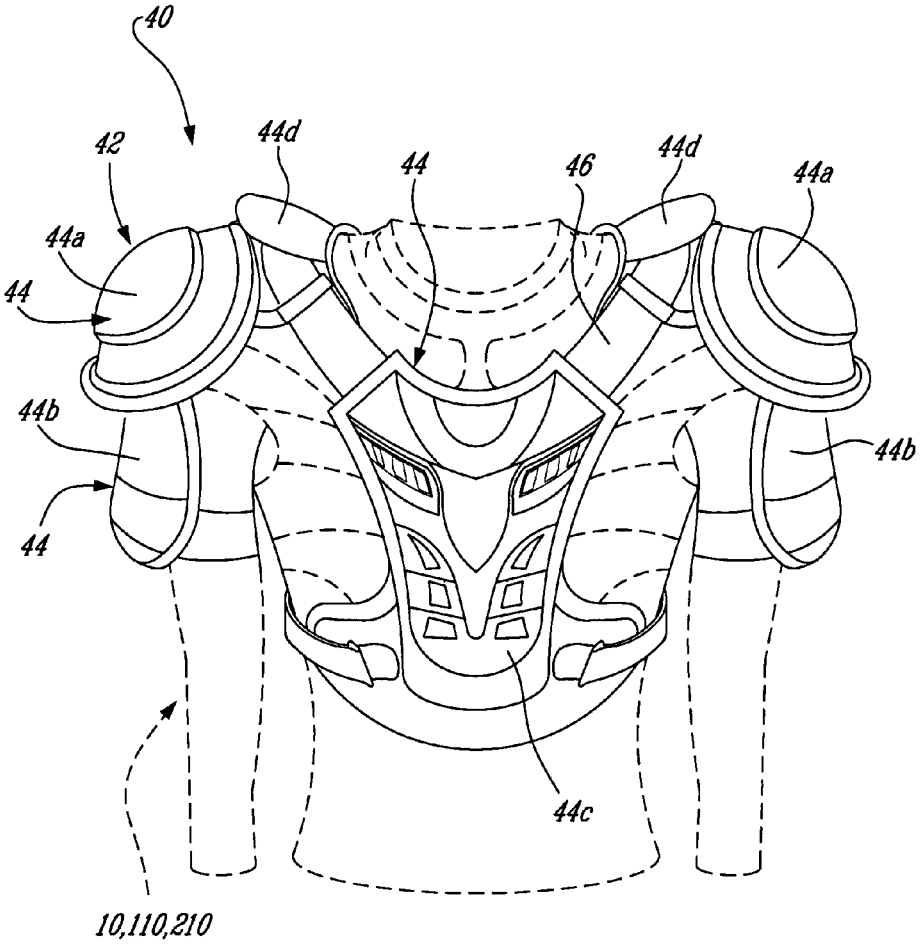
FIG. 6 is a front view of a protective garment according to a particular embodiment of the present invention, including an outer garment shown in combination with an inner garment which can be for example any one of the inner garments of FIGS. 1-5, the inner garment being depicted in dotted lines for improved clarity.
Figure 7:
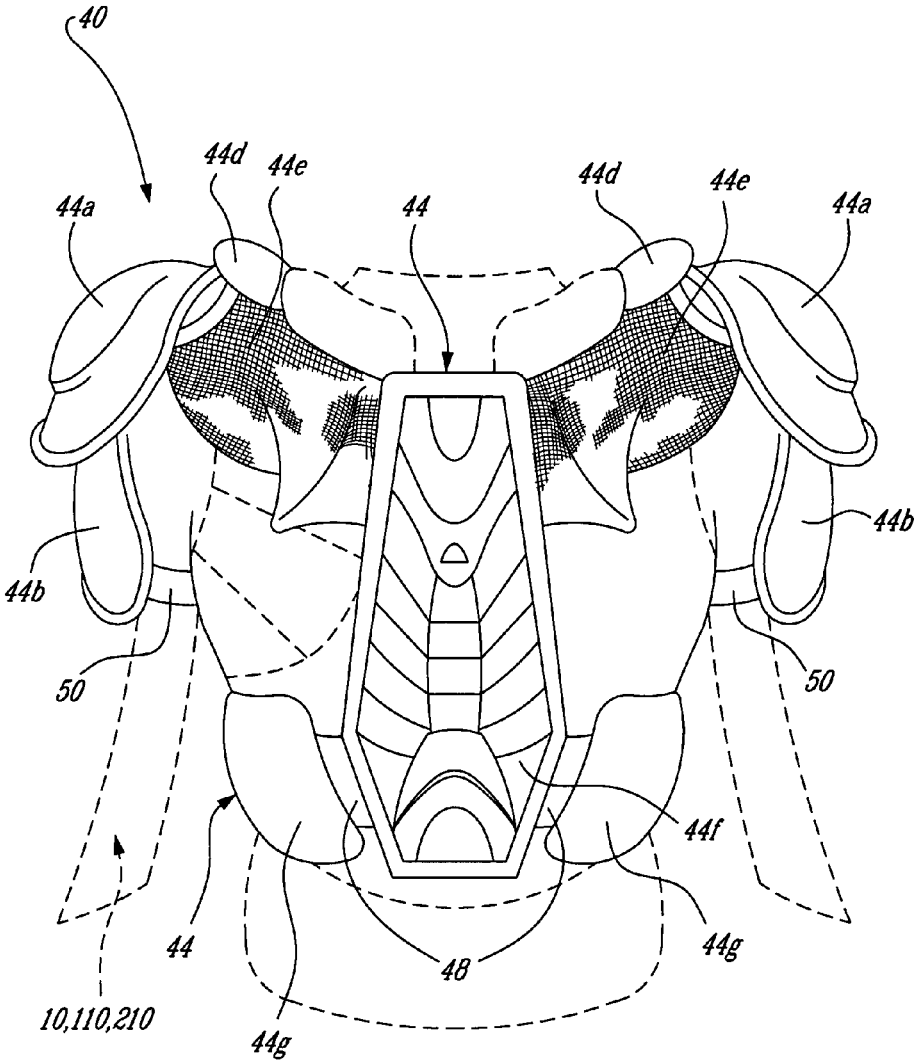
FIG. 7 is a rear view of the protective garment of FIG. 6.

Referring to FIGS. 6-7, a protective garment 40 according to a particular embodiment of the present invention is shown. The protective garment 40 includes an outer garment or outer shell 42 worn over an inner garment, which can be for example any one of the inner garments 10, 110, 210 previously shown and described. The outer and inner garments are independent, i.e. they can be separated from one another. In a particular embodiment the outer garment 42 is retained over the wearer's body without being attached to the inner garment 10, 110, 210.

Figure 9A:
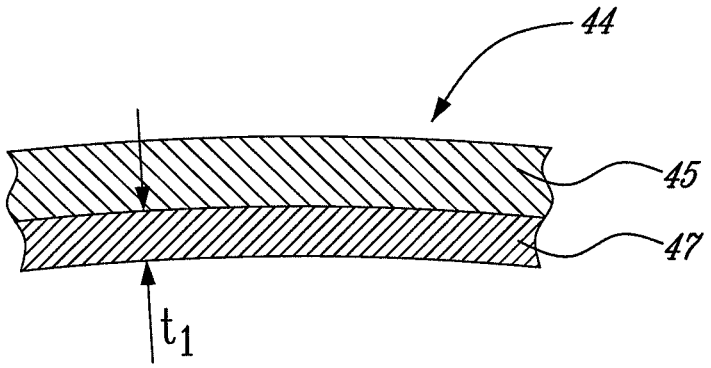
FIGS. 9A-9B are partial cross-sections of pads of the outer garment and the inner garment, respectively, in accordance with a particular embodiment.
Figure 9B:
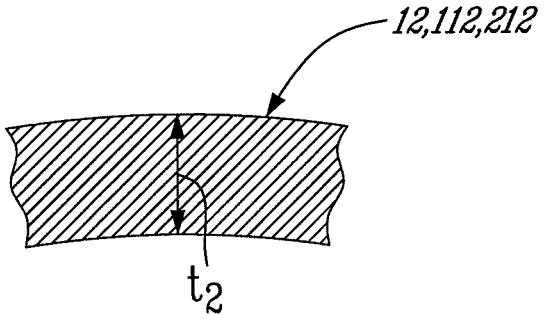

The outer garment 42 includes a series of protective pads or shells 44 which are flexibly connected to one another. The protective pads 44 include at least a portion thereof made of a material which is more rigid that the cushioning pads 12, 112, 212, such as to provide impact protection to the wearer. In a particular embodiment, the protective pads 44 include an outer layer 45 of molded plastic, for example polyethylene, polycarbonate, etc., or of an adequate composite material. The protective pads 44 also optionally include an inner layer 47 of cushioning material attached to an inside surface of the rigid outer layer 45 for improved comfort. However this layer 47 of cushioning material has a thickness $t_1$ (FIG. 9A) smaller than that of the layer of cushioning material usually found in typical protective garments, and preferably smaller than the thickness t2 (FIG. 9B) of the cushioning pads 12, 112, 212 of the inner garment 10, 110, 210.

In the embodiment shown, the protective pads 44 comprise two shoulder caps 44*a* each overlying a shoulder joint and two upper arm caps 44*b* each overlying part of an upper arm up to the elbow and flexibly connected to a respective one of the shoulder caps 44*a*. Referring particularly to FIG. 6, the protective pads 44 also comprise a front plate 44*c* overlying the sternum and part of the abdomen and flexibly connected to the shoulder caps 44*a* by a pair of flexible straps 46, and two clavicle caps 44*d* each overlying a respective shoulder and clavicle adjacent the shoulder cap 44*a* and attached to a respective one of the straps 46 and/or shoulder cap 44*a*. Referring particularly to FIG. 7, the protective pads 44 also comprise two scapula caps 44*e* each overlying a respective scapula and flexibly connected to the shoulder caps 44*a*, a back plate 44*f* overlying the spine and flexibly connected to the scapula caps 44*e*, and two kidney caps 44*g* each overlying a respective kidney and flexibly connected to both the front and back plates 44*c*, 44*f* by flexible straps 48.

The outer garment 42 further includes flexible retaining straps 50 extending from each upper arm cap 44*b* around the respective upper arm to retain the outer garment 42 around the inner garment 10, 110, 210. In addition, the kidney caps 44*g*, front plate 44*c* and back plate 44*f* interconnected by the flexible straps 48 form a belt-like retaining means further helping retain the outer garment 42 in place without the outer garment 42 being attached to the inner garment 10, 110, 210.

In an alternate embodiment, the outer garment 42 is removably attached to the inner garment 10, 110, 210, through appropriate detachable fasteners, such as for example Velcro™ strips, buttons, snaps, etc.

The protective pads 44 can be made of different materials or different combinations of similar materials. For example, in a particular embodiment, the scapula caps 44*e* are made of rigid plastic material such as polyethylene, include a layer of cushioning material attached to an inner surface thereof and are contained in an envelope of breathable mesh material. In a particular embodiment, all of the protective pads 44 are made of rigid plastic material and include an inner layer of, cushioning material.

In the embodiment shown, a substantial portion of the inner garment 10, 110, 210 is not covered by the outer garment 42. For example, the outer garment 42 does not substantially cover the ribs of the wearer, which are preferably covered by one or more cushioning pads 12, 112, 212 provided on the inner garment 10, 110, 210.

In a particular embodiment, the surface of the body covered by the outer garment 42 is kept to a minimum to provide adequate protection for the activity performed, in order to minimize the weight and maximize the flexibility and breathability of the protective garment 40. For example, in a particular embodiment which is especially adapted for hockey, the outer garment 42 includes protective pads for protecting only the shoulder joints, shoulder blades, clavicles, sternum and spine. In an alternate embodiment, the outer garment 42 can be limited to providing protection to the shoulders of the wearer.

Figure 8:
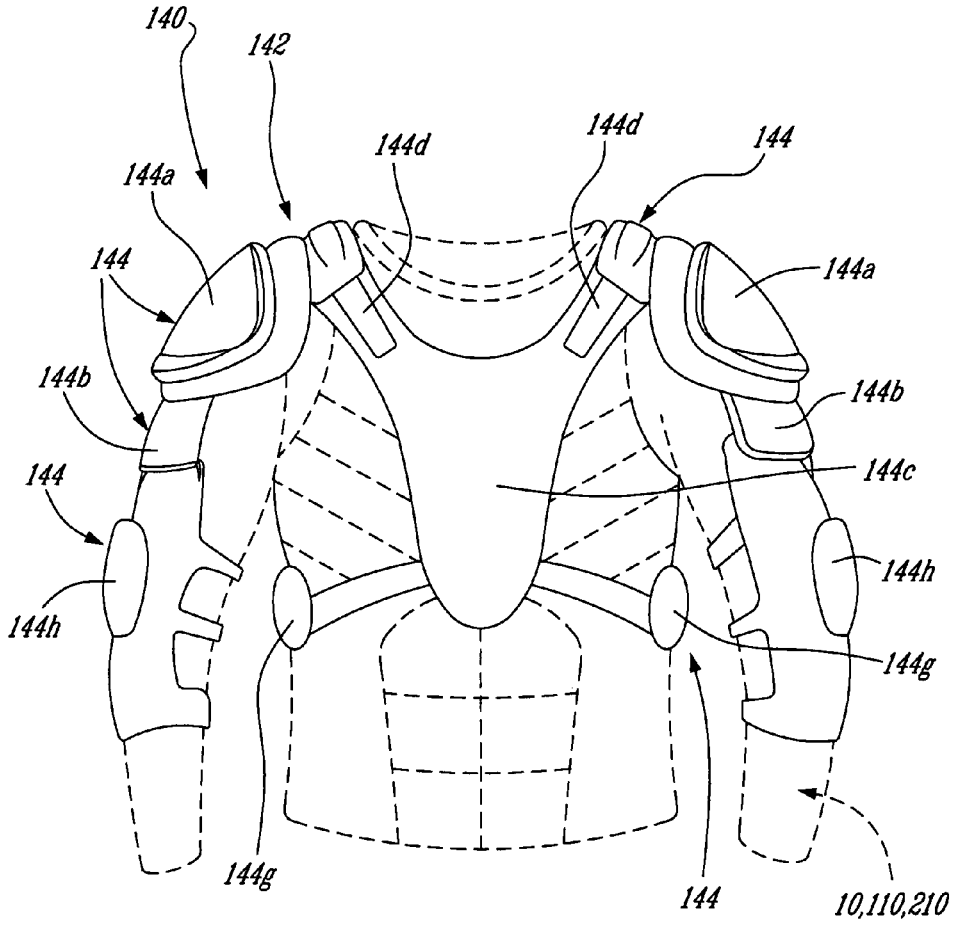
FIG. 8 is a front view of a protective garment according to an alternate embodiment of the present invention, including an outer garment shown in combination with an inner garment which can be for example any one of the inner garments of FIGS. 1-5, the inner garment being depicted in dotted lines for improved clarity.

Referring to FIG. 8, a protective garment 140 according to an alternate embodiment of the present invention is shown. The outer garment or shell 142 of this protective garment 140 is similar to the outer garment 42 described above, with protective pads or shells 144 including for example shoulder caps 144*a*, upper arm caps 144*b*, a front plate 144*c*, clavicle caps 144*d*, scapula caps and a back plate (not shown), and kidney caps 144*g*. In addition, the protective pads 144 include elbow protectors each including a rigid elbow cap 144*h* overlying the respective elbow, each elbow protector being flexibly connected to the adjacent upper arm cap 144*b*.

In a particular embodiment, the outer and inner garments cooperate such that every portion of the torso of the wearer is covered by a cushioning pad 12, 112, 212 and/or a protective pad 44, 144.

The separate outer and inner garments advantageously allow for the inner garment which absorbs sweat during use to be easily washed, and in a particular embodiment to be machined-washable, such as to improve the overall aspect or the protective garment 40, 140. In addition, each of the inner and outer garments can be replaced independently of another, allowing for only the worn-out part of the protective garment 40, 140 to be replaced at reduced cost and/or to use different outer garment/inner garment combinations for different sports, for playing a same sport in different conditions, for games and practice sessions, etc.

In a particular embodiment, the cushioning pads 12, 112, 212 can be removed from the inner garment and/or the protective pads 44, 144 can be detached from the outer shell, such that each cushioning pad 12, 112, 212 and/or protective pad 44, 144 can be replaced independently of the others to replace a defective element and/or to customize the protective garment 40, 140 depending on the activity being performed. For example, the cushioning pads 12, 112, 212 can be removably received in pockets of the inner garment or attached to the inner garment through detachable fasteners such as Velcro™, and cushioning pads of different thicknesses and/or different materials can be provided for being alternately received in a same pocket or at a same location on the inner garment, such as to be able to define a customized protection.

The separate outer and inner garments also allow for the bulky portion of the protective garment 40, 140, i.e. the outer garment, to be reduced in size and coverage as much as possible while keeping the remaining protection in a form-fitting configuration on the inner garment, which provides for a better fit of the protective garment 40, 140 to the wearer as well as improved comfort.

Although the protective garment has been described here in a form adapted to protect the torso of the wearer, the protective garment with the inner garment including cushioning pads on specific portions of the body and the separate outer garment including more rigid protective pads can also be in alternate forms adapted to protect other parts of the body. Examples of such alternate forms include a protective pant including a separate inner form-fitting stretchable pant with cushioning pads covered by an outer shell with protective pads, the protective pant being for example a knee-length pant with the inner pant including for example thigh cushioning pads, or the protective pant being longer with the outer shell including for example shin caps overlying the shins and/or knee caps overlying the knees; protective glove including an inner form-fitting stretchable glove with cushioning pads to cover selected portions of the hand, and an outer shell with more rigid protective pads, for example protecting the back of the hand and/or the thumb from impact; etc.

The embodiments of the invention described above are intended to be exemplary. Those skilled in the art will therefore appreciate that the foregoing description is illustrative only, and that various alternate configurations and modifications can be devised without departing from the spirit of the present invention. For example, elements and/or characteristics from the various embodiments shown can be combined. Accordingly, the present invention is intended to embrace all such alternate configurations, modifications and variances which fall within the scope of the appended claims.

The invention claimed is:

1. A protective garment comprising:

a form-fitting, stretchable inner garment for covering part of a body of a wearer, the inner garment including a plurality of cushioning pads attached thereto with a substantial portion of the inner garment being free of the cushioning pads; and an outer shell partially overlying the inner garment with at least some of the cushioning pads being at least partially left uncovered by the outer shell, the outer shell overlying at least part of the portion of the inner garment free of the cushioning pads, the outer shell including a plurality of protective pads flexibly interconnected independently of the inner garment and cooperating with the cushioning pads to protect at least a major part of the portion of the body, the protective pads each including a rigid layer more rigid than all the cushioning pads of the inner garment, at least some of the protective pads including an inner layer of cushioning material more flexible than the rigid layer and having a thickness less than that of the cushioning pads, and the outer shell being separable from the inner garment.

2. The protective garment according to claim 1, wherein the inner garment is a t-shirt.

3. The protective garment according to claim 2, wherein the cushioning pads are configured to overlay one or more of shoulders, a lower abdomen, upper arms, wrists, a lower back, ribs, a lower neck, a sternum, clavicles and scapulae of the wearer.

4. The protective garment according to claim 2, wherein the protective pads are configured to overlay one or more of shoulders, upper arms, elbows, a lower abdomen, clavicles, scapulae, kidneys, a sternum and a spine of the wearer.

5. The protective garment according to claim 1, wherein at least some of the protective pads are spaced apart from one another and interconnected by flexible straps.

6. The protective garment according to claim 1, wherein the outer shell is configured to be retained to the body of the wearer without being connected to the inner garment.

7. The protective garment according to claim 1, wherein at least some of the portions of the inner garment free of the cushioning pads are made of stretchable mesh material.

8. The protective garment according to claim 1, wherein each of the cushioning pads is individually and permanently attached to the inner garment through stitching.

9. The protective garment according to claim 1, wherein the cushioning pads include spaced apart groups of adjacent pads, with a distance between adjacent cushioning pads of a same one of the groups being smaller than a distance between adjacent ones of the groups.

10. The protective garment according to claim 1, wherein at least some of the interconnected protective pads are detachable from one another.

11. The protective garment according to claim 1, wherein the rigid layer of the protective pads is made of molded plastic material.

12. The protective garment according to claim 1, wherein the cushioning pads are made of foam material.

13. The protective garment according to claim 1, wherein the cushioning pads are disposed in a plurality of spaced apart sections each covered by at least one of the cushioning pads with the inner garment being free of the cushioning pads between adjacent ones of the sections, at least some of the sections having different shapes from one another.

14. A protective upper body garment comprising:

an inner garment made of stretchable material and including cushioning pads attached to the stretchable material and provided on only distinct zones of the inner garment with a remainder of the inner garment being free of the cushioning pads, at least one of the distinct zones having a different shape from that of at least one other of the distinct zones, the cushioning pads including rib cushioning pads at least substantially covering one of the zones extending from a front to a rear and over a side of the inner garment and configured to overlay ribs of the wearer; and an outer garment separate from the inner garment and retained thereover with at least a portion of the rib cushioning pads being left uncovered by the outer garment, the outer garment having a plurality of protective pads including at least rigid shoulder caps flexibly interconnected to one another independently of the inner garment, the shoulder caps being positioned for overlying shoulders of the wearer, the plurality of protective pads each including a rigid layer more rigid than all the cushioning pads of the inner garment, at least some of the protective pads including an inner layer of cushioning material more flexible than the rigid layer and having a thickness less than that of the cushioning pads.

15. The protective garment according to claim 14, wherein the outer garment further includes at least one or more of a rigid front plate configured to overlay a sternum of the wearer, a rigid back plate configured to overlay a spine of the wearer, rigid upper arm caps configured to overlay upper arms of the wearer and rigid elbow caps configured to overlay elbows of the wearer, the at least one or more of the front plate, back plate, upper arm caps and elbow caps being flexibly interconnected to the shoulder caps independently of the inner garment.

16. The protective garment according to claim 14, wherein the cushioning pads are configured to overlay at least one or more of shoulders, a lower abdomen, upper arms, wrists, a lower back, ribs, a lower neck, a sternum, clavicles and scapulae of the wearer.

17. A protective garment comprising:

an inner stretchable garment including irregularly spaced apart cushioning pads attached to the garment and configured to overlay at least partially ribs of a wearer, the inner garment having a substantial portion thereof free of the cushioning pads; and an outer garment including protective shells configured to overlay at least partially shoulders, an abdomen, and a back of the wearer, the protective shells being flexibly interconnected independently of the inner garment, the outer garment being removably retained over the inner garment with at least part of the cushioning pads configured to at least partially overlay the ribs of the wearer being left uncovered by the outer garment, the plurality of protective shells each including a rigid layer more rigid than all the cushioning pads of the inner garment, at least some of the protective shells including an inner layer of cushioning material more flexible than the rigid layer and having a thickness less than that of the cushioning pads.

18. The protective garment according to claim 17, wherein the cushioning pads are also configured to overlay the shoulders of the wearer and are partially covered by the outer garment.

* * * * *